US006320566B1

(12) United States Patent
Go

(10) Patent No.: US 6,320,566 B1
(45) Date of Patent: Nov. 20, 2001

(54) DRIVING CIRCUIT FOR LIQUID CRYSTAL DISPLAY IN DOT INVERSION METHOD

(75) Inventor: Yong Suk Go, Kyungsangbook-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/049,469

(22) Filed: Mar. 27, 1998

(30) Foreign Application Priority Data

Apr. 30, 1997 (KR) ..... 97-16428

(51) Int. Cl.[7] ..... G09G 3/36
(52) U.S. Cl. ..... 345/99; 345/100
(58) Field of Search ..... 345/89–100; 349/149; 327/269

(56) References Cited

U.S. PATENT DOCUMENTS 4,728,972 * 3/1988 Stephany et al. ..... 346/160
5,253,091 * 10/1993 Kimura et al. ..... 359/55
5,489,867 * 2/1996 Tamanoi ..... 327/269
5,546,102 * 8/1996 Scheffer et al. ..... 345/100
5,724,057 * 3/1998 Kimura et al. ..... 345/89
5,739,887 * 4/1998 Ueda et al. ..... 349/149
5,748,165 * 5/1998 Kubota et al. ..... 345/96
5,886,679 * 3/1999 Matsuda et al. ..... 345/96
5,892,493 * 4/1999 Enami et al. ..... 345/94
5,926,161 * 7/1999 Furuhashi et al. ..... 345/100

FOREIGN PATENT DOCUMENTS 63-229495 9/1988 (JP) .
8-202317 8/1996 (JP) .

* cited by examiner

*Primary Examiner*—Steven Saras
*Assistant Examiner*—Srilakshmi Kumar
(74) *Attorney, Agent, or Firm*—Morgan, Lewis & Bockius LLP

(57) ABSTRACT

The present invention provides a driving circuit for providing display signals to a liquid crystal display panel through a plurality of data lines. The driving circuit includes a clock signal generator producing a first clock signal and a second clock signal, a phase of the first clock signal being 180-degrees from that of a phase of the second clock signal; and a data driver to be connected to the plurality of data lines through one side of the liquid crystal display panel, the data driver including a latch circuit having a plurality of output terminals each to be connected to the respective one of the data lines through a respective XOR gate, respective XOR gates connected to the odd data lines receiving the first clock signal to output first pixel driving signals having a predetermined polarity to the respective odd data lines, respective XOR gates connected to the even data lines receiving the second clock signal to output second pixel driving signals having a reverse polarity relative to the first video signals to the respective even data lines.

9 Claims, 11 Drawing Sheets

FIG. 4A
CONVENTIONAL ART

| | | | | | |
|---|---|---|---|---|---|
| + | + | + | + | + | + |
| − | − | − | − | − | − |
| + | + | + | + | + | + |
| − | − | − | − | − | − |
| + | + | + | + | + | − |

FIG. 4B
CONVENTIONAL ART

| | | | | | |
|---|---|---|---|---|---|
| − | − | − | − | − | − |
| + | + | + | + | + | + |
| − | − | − | − | − | − |
| + | + | + | + | + | + |
| − | − | − | − | − | − |

FIG. 5A
CONVENTIONAL ART

| | | | | | |
|---|---|---|---|---|---|
| + | − | + | − | + | − |
| + | − | + | − | + | − |
| + | − | + | − | + | − |
| + | − | + | − | + | − |
| + | − | + | − | + | − |

FIG. 5B
CONVENTIONAL ART

| | | | | |
|---|---|---|---|---|
| − | + | − | + | − |
| − | + | − | + | − |
| − | + | − | + | − |
| − | + | − | + | − |
| − | + | − | + | − |

FIG. 6A
CONVENTIONAL ART

| | | | | |
|---|---|---|---|---|
| + | − | + | − | + |
| − | + | − | + | − |
| + | − | + | − | + |
| − | + | − | + | − |
| + | − | + | − | + |

FIG. 6B
CONVENTIONAL ART

| | | | | |
|---|---|---|---|---|
| − | + | − | + | − |
| + | − | + | − | + |
| − | + | − | + | − |
| + | − | + | − | + |
| − | + | − | + | − |

DRIVING CIRCUIT FOR LIQUID CRYSTAL DISPLAY IN DOT INVERSION METHOD

This application claims the benefit of Korean Application P97-16428, filed in Korea on Apr. 30, 1997, which is hereby incorporated by reference.

BACKGROUND OF THE INVENTION

1. Field of the Invention

The present invention relates to a circuit for driving a liquid crystal display device (LCD), and more particularly, to a driving circuit for dot inversion method using a line inversion mechanism and single bank mode.

2. Discussion of the Related Art

Cathode ray tubes (CRT) are widely used in display devices, such as television sets and display monitors for computers because CRTs can easily reproduce color and have high response speed. However, CRTs are too large and heavy, and consume too much power to be portable. Because of this, it is desirable to replace CRTs with other types of display. To overcome the above mentioned disadvantages of the CRT, a considerable amount of research and development has been conducted to design alternative types of display, such as liquid crystal displays, plasma display panels, and so on. Among them, a liquid crystal display is one of the most widely used devices. This is because the LCD does not have the bulky electron gun as is sed with the CRT, and the LCD can be applied to a thin television set that is mounted on the wall. Furthermore, the LCD can be applied to a portable display device, such as a note-book computer, because the power consumption is very low. Accordingly, the LCD can be driven by a battery.

The schematic structure of a conventional LCD is shown in FIGS. 1 and 2. FIG. 1 shows the perspective view, and FIG. 2 shows the structure of the lower panel. The LCD includes an upper panel 21, which has a polarization plate 20, a color filter 22, and a common electrode 23; a lower panel 25, which has thin film transistors (TFTs) 13 and pixel electrodes 26; and a liquid crystal material 24 inserted between the upper panel 21 and the lower panel 25. The lower panel 25 further includes a plurality of scan lines 14 and a plurality of data lines 15. The scan lines 14 and the data lines 15 perpendicularly cross each other. At the area surrounded by the neighboring scan lines and data lines, the pixel electrode 26 is formed. At each of the intersections of the scan lines and data lines, the TFT 13 is formed. Each of the area surrounded by the neighboring scan lines and data lines is called a pixel. Thus, one pixel includes the pixel electrode 26, the common electrode 23, and the liquid crystal material 24 in between. In addition, the lower panel 25 has a data driver IC 11 connected to the data lines 15 and a scan driver IC 10 connected to the scan lines 14 (FIG. 2).

The TFT includes a gate electrode, a source electrode and a drain electrode. The gate electrode is connected to the scan line, the source electrode is connected to the data line, and the drain electrode is connected to the pixel electrode. The drain electrode and the source electrode are connected with a semiconductor layer. The TFT works as a switch that passes a data voltage applied to the data line to the drain electrode when a scan voltage is applied to the gate electrode through the scan line. The data voltage applied to the drain electrode is applied to the pixel electrode connected to the drain electrode.

As shown in FIG. 2, video data is applied from a controller 17 to the data driver IC 11. The video data includes grey scaled data of red (R), green (G), and blue (B), which are applied to the corresponded pixel electrodes 26. The data driver IC 11 latches the video data that come from the controller IC 17 until all the data of one line are inputted. Then, the video data of one line is transferred to the data line at once. At that time, the scan driver IC 10 applies a scan voltage to the scan line 14 connecting TFTs 13 to reproduce the video images at the pixel electrodes according to the scan signal of the controller 17.

An example of the TFT is explained with reference to FIG. 3. FIG. 3 shows a cross-sectional view of the TFT. A gate electrode 30 is formed on the lower substrate 25, and a gate insulating layer 31 is formed thereon. An active layer 34 made of amorphous silicon or polysilicon, for example, is formed on the gate insulating layer opposite the gate electrode 30. Source and drain electrodes 32, 33 are connected to both sides of the active layer 34 through an ohmic contact layer 36 (or $n^+$ layer). A protective layer 35 is formed over the resultant structure. Finally, pixel electrode 26 made of transparent conductive material, such as indium tin oxide (ITO), is formed on the protective layer 35 to be connected to the drain electrode 33 through a contact hole made in the protective layer 35.

When the scan voltage is applied to a scan line, all the TFTs connected to the scan line are turned on. Accordingly, the video data applied to the data lines are sent to the pixel electrode through the TFTs. Therefore, a voltage is applied to each pixel electrode. On the other hand, constant voltage is applied to the common electrode. Accordingly, a voltage difference is formed between the pixel electrode and the common electrode, and an electric field is formed by the voltage difference. The arrangement (or orientation) of the liquid crystal molecules between the pixel and common electrodes is changed according to the electric field, modulating the amount of light transmission at the pixel. Thus, there are differences in light transmission between the pixel applied with a data voltage and the pixel not applied with a data voltage. Using these properties of pixels, the LCD works as a display device.

Generally, an LCD uses one of the line inversion, the column inversion, and the dot inversion methods, according to the phase of the applied signal voltage. In the line inversion, as shown in FIGS. 4*a* and 4*b*, the polarity of voltage applied to the pixel electrodes is reversed at every scan line (row). In the column inversion, as shown in FIGS. 5*a* and 5*b*, the polarity of voltage applied to the pixel electrodes is reversed at every data line (column). In the dot inversion method, as shown in FIGS. 6*a* and 6*b*, the polarity of voltage is reversed at every row and column. FIGS. 4*a*, 5*a*, and 6*a* represent the phases of the common electrode voltages in a particular frame, and FIGS. 4*b*, 5*b*, and 6*b* represent the phases of the pixel electrode voltages in the same frame. In the next frame, these phases are reversed. The reason for changing the phase of signal is that if the applied voltages to the common and pixel electrodes are the same value in the entire respective electrodes, then the liquid crystal is heated, and the quality of the picture screen deteriorates.

In the line and column inversion method, a flicker problem occurs. The reason is the following. When a scan line signal is "HIGH," all the TFTs connected to the scan line are turned on, and the data signals are sent to the pixel electrodes from the source electrodes connected to the data lines. Then, the liquid crystal is driven by the voltage difference between the pixel electrode and the common electrode. When the scan line signal is "LOW", all the TFTs connected to the scan line are turned off. At that time, the voltage applied to the pixel electrodes remains in the pixel electrode, so the liquid crystal is still in the same condition, and the display signals are maintained. However, the stored signal voltage in the pixel electrode is reduced by ΔV by coupling capacitors (Cgs), which are formed between the scan lines and data lines. Since the voltage in the pixel electrodes are not maintained constant, the display has a flicker problem.

In the dot inversion method, the flicker problem does not occur because the neighboring pixels have the different polarity in signal. If the first pixel is applied with a positive signal, the second pixel (neighboring pixels) is applied with a negative signal. At the next period, the first pixel has a negative signal and the second pixel has a positive signal. That is, the pixel signal is a pulse signal type. The voltage charge ΔV, which occurs in positive and negative states, can be moderated by controlling the common voltage. Therefore, the voltage differences can be maintained constant, solving the flicker problem.

An example of the dot inversion method is described with reference to FIGS. 7, 8, and 9. See also Japanese Patent Laid Open Publication No. 63-229495. A plurality of common electrodes are disposed in parallel with the data bus lines. The common electrodes are grouped into two groups. One group is constructed by the mutually connected odd-numbered common electrodes, and the other group is constructed by the mutually connected even-numbered electrodes. The odd-numbered common electrodes are applied with the first common voltage Com1, and the even-numbered common electrodes are applied with the second common voltage Com2. On the lower panel, the odd data lines are connected to the first driver IC $DD_1$ disposed at the upper side of the lower panel, and the even data lines are connected to the second driver IC $DD_2$ disposed at the lower side of the lower panel (FIG. 8). The data signals output from the first driver IC $DD_1$ have phases 180-degree different from that of the second driver IC $DD_2$. This structure, having the driver ICs at the two sides, is called a double bank mode. On the other hand, the structure, having the driver ICs at only one side, is called a single bank mode.

In order to adopt the dot inversion method for driving an LCD, the structure of the LCD is designed in double bank mode. Because inverters 93, such as "NOT gate," should be disposed in every other output terminal of the data driver IC 90, as shown in FIG. 9, designing the dot inversion method in a single bank mode is very complicated and difficult. However, in the double bank driving method, the visible area of the display panel is smaller than the single bank mode because the driver ICs are disposed at the two sides of the panel. In the COG (Chip On Glass) technique, this problem is more serious.

SUMMARY OF THE INVENTION

Accordingly, the present invention is directed to a driving circuit for a dot inversion method that substantially obviates the problems due to limitations and disadvantages of the related art.

An object of the present invention is to provide a driving circuit for a liquid crystal display in a dot inversion method and a single bank mode.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a liquid crystal display device, including a first substrate including a plurality of odd data lines and even data lines and a plurality of scan lines, the plurality of odd and even data lines being substantially perpendicular to the plurality of scan lines; a second substrate opposite the first substrate, the second substrate including a plurality of odd-numbered common electrodes and even-numbered common electrodes disposed substantially in parallel with the plurality of odd and even data lines, respectively; a clock signal generator producing a first clock signal and a second clock signal, a phase of the first clock signal being 180-degrees from that of a phase of the second clock signal; a common voltage generator applying a first common voltage to the odd-numbered common electrodes disposed on the second substrate, and a second common voltage to the even-numbered common electrodes disposed on the second substrate; and a data driver connected to the plurality of data lines through one side of the first substrate, the data driver including a latch circuit having a plurality of output terminals each connected to a respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines.

In another aspect, the present invention provides a circuit for driving a liquid crystal display device with a video data, including a latch for latching the video data to output video signals through a plurality of output terminals, the plurality of output terminals being divided into a first group and a second group; a clock signal generator producing a first clock signal and a second clock signal, the phase of the first clock signal being 180-degrees from that of the second clock signal; a plurality of first logical gates each performing an exclusive OR operation with the first clock signal and the video signal from the first group of the output terminals of the latch to output an operated signal; and a plurality of second logical gates each performing an exclusive OR operation with the second clock signal and the video signal from the second group of the output terminals of the latch to output an operated signal.

In another aspect, the present invention provides a liquid crystal display device, including a first substrate including a plurality of data lines being separated as odd data lines and even data lines, a plurality of scan lines substantially perpendicular to the plurality of data lines, a plurality of pixel electrodes each disposed at areas surrounded by the scan lines and data lines, and a plurality of thin film transistors each disposed at a respective intersection of the data lines and the scan lines, a gate of each thin film transistor being connected to an adjacent scan line, a source of each thin film transistor being connected to an adjacent data line, and a drain of each thin film transistor being connected to an adjacent pixel electrode; a second substrate opposite the first substrate, the second substrate including a plurality of odd common electrodes and even common electrodes disposed substantially in parallel with the plurality of data lines; a liquid crystal material interposed between the first substrate and the second substrate; a clock signal generator producing a first clock signal and a second clock signal, the phase of the first clock signal being 180-degrees from that of the second clock signal; a common voltage generator applying a first common voltage to the odd common electrodes disposed on the second substrate, and applying a second common voltage to the even common electrodes disposed on the second substrate; a data driver connected to the plurality of data lines through one side of the first substrate, the data driver including a latch circuit having a plurality of output terminals each connected to a respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines; and a scan driver outputting scan signals to the plurality of scan lines on the first substrate to drive the thin film transistors connected thereto.

In a further aspect, the present invention provides a driving circuit for providing display signals to a liquid crystal display panel through a plurality of data lines being separated as odd data lines and even data lines, the driving circuit including a clock signal generator producing a first clock signal and a second clock signal, a phase of the first clock signal being 180-degrees from that of a phase of the second clock signal; and a data driver to be connected to the plurality of data lines through one side of the liquid crystal display panel, the data driver including a latch circuit having a plurality of output terminals each to be connected to the respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIGS. 4*a* and 4*b* show the phases of the voltage applied to pixels according to a line inversion method in the conventional liquid crystal display;

FIGS. 5*a* and 5*b* show the phases of the voltage applied to pixels according to a column inversion method in the conventional liquid crystal display;

FIGS. 6*a* and 6*b* show the phases of the voltage applied to pixels according to a dot inversion method in the conventional liquid crystal display;

DETAILED DESCRIPTION OF THE PREFERRED EMBODIMENTS

Reference will now be made in detail to the preferred embodiments of the present invention, examples of which are illustrated in the accompanying drawings.

Figure 1:
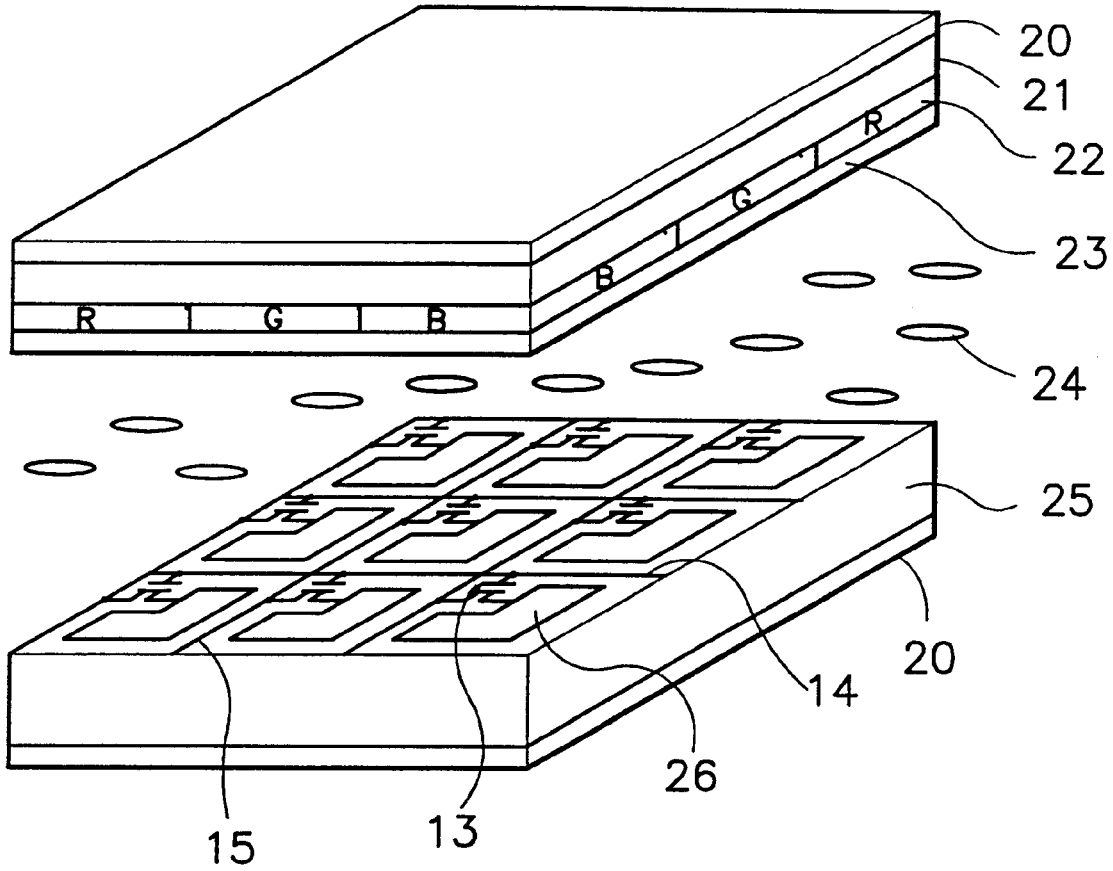
FIG. 1 CONVENTIONAL ART
FIG. 1 shows a perspective views of a conventional liquid crystal display device.
Figure 2:
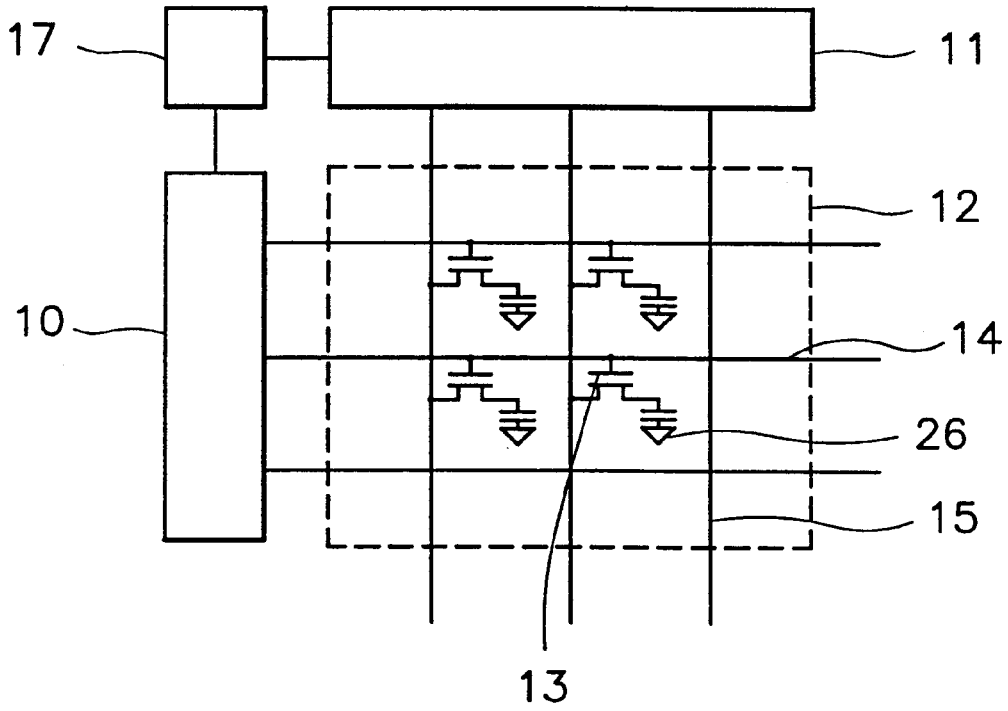
FIG. 2 CONVENTIONAL ART
FIG. 2 shows the structure of the lower panel in the conventional liquid crystal display device.
Figure 3:
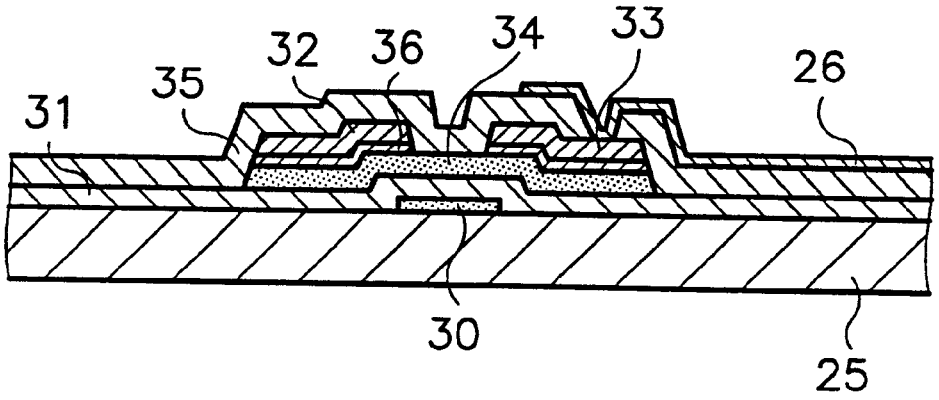
FIG. 3 CONVENTIONAL ART
FIG. 3 is a cross-sectional view of an example of a thin film transistor according to the conventional liquid crystal display.
Figure 7:
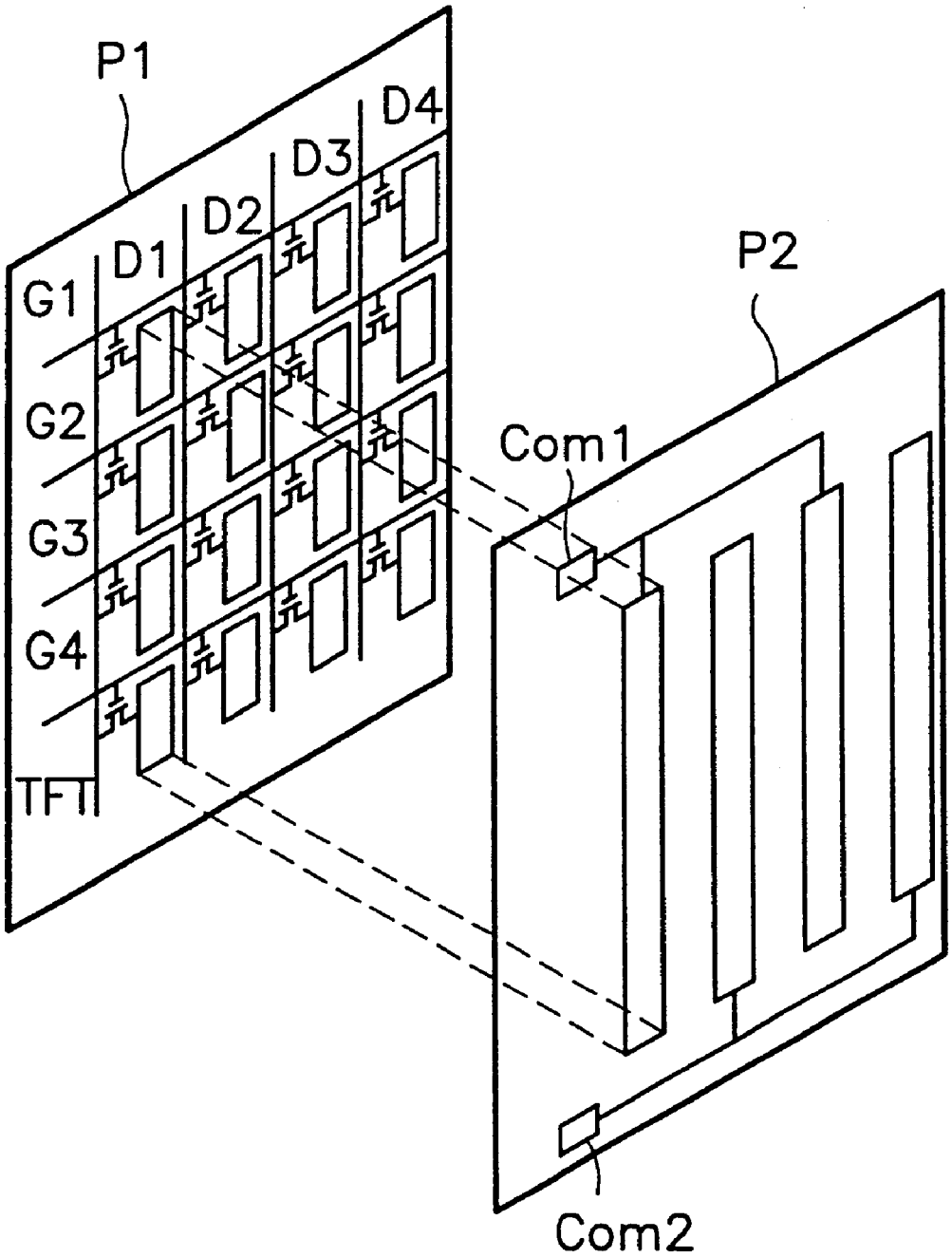
FIG. 7 CONVENTIONAL ART
FIG. 7 shows the structure of the common electrodes and the TFT array in a conventional dot inversion method.
Figure 8:
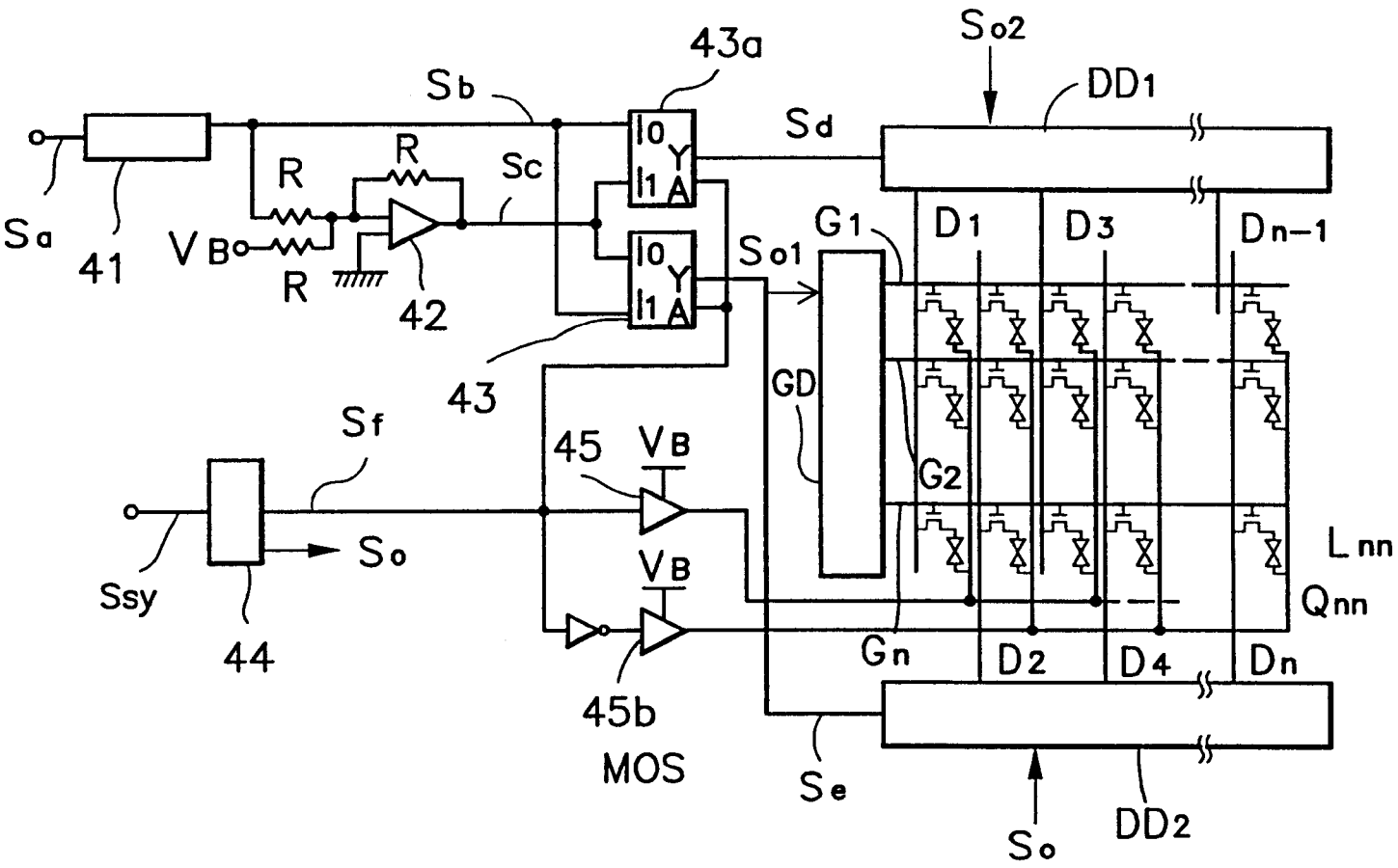
FIG. 8 CONVENTIONAL ART
FIG. 8 is a circuit diagram showing the conventional dot inversion method of FIG. 7 in a double bank mode.
Figure 9:
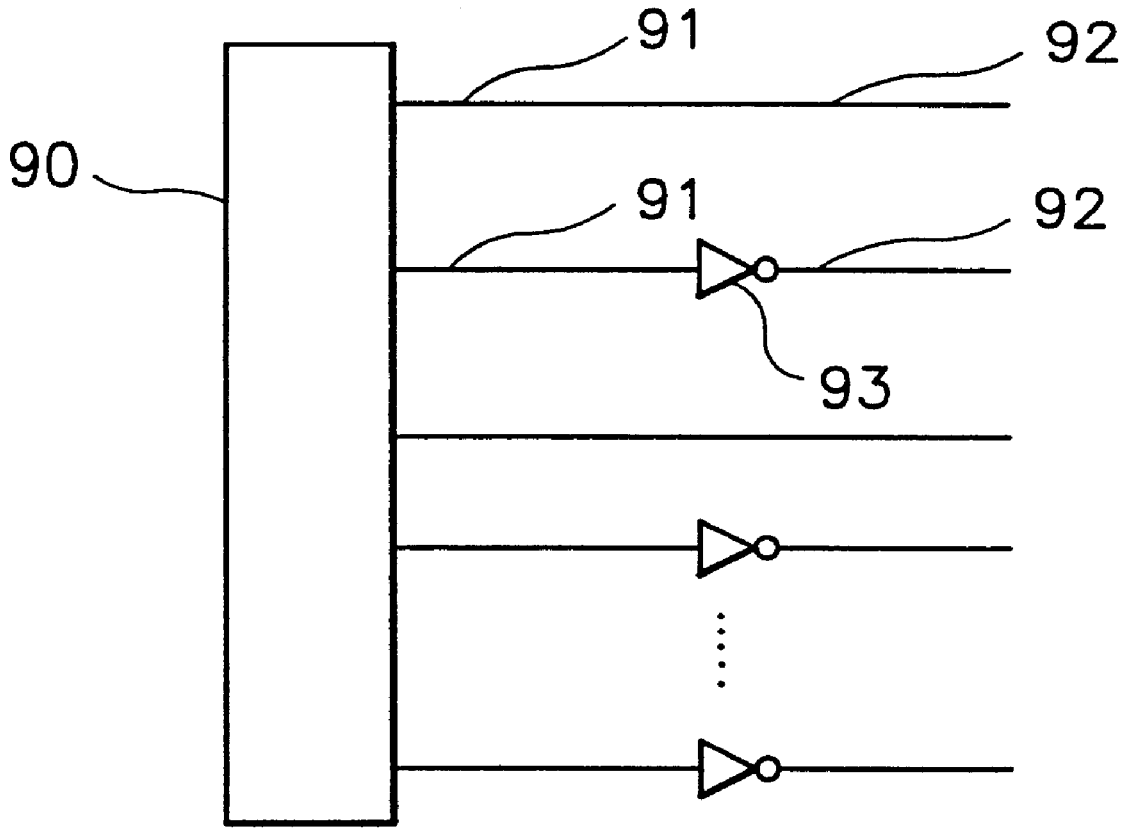
FIG. 9 CONVENTIONAL ART
FIG. 9 is the circuit diagram showing the data driver IC including a NOT gate in the conventional dot inversion method of FIG. 8.
Figure 10:
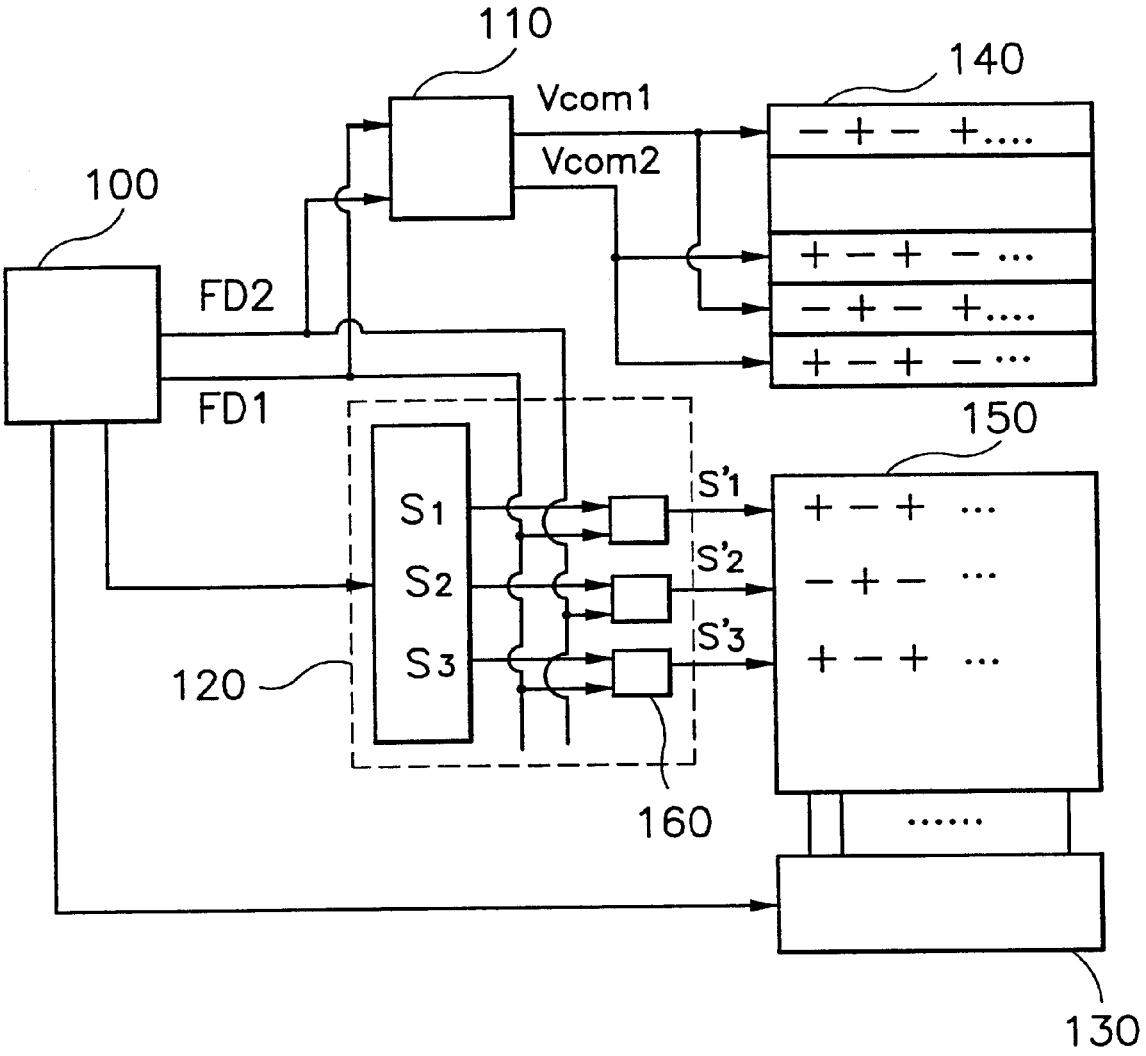
FIG. 10 is a circuit diagram showing a driving circuit according to a preferred embodiment of the present invention.

A driving circuit according to a preferred embodiment of the present invention, as shown in FIG. 10, includes a controller IC 100 generating a first clock signal FD1 and a second clock signal FD2, the phase of which is 180-degree different from that of the first clock signal FD. The driving circuit farther includes a data driver IC 120 applied with the FD1 and the FD2 signals and outputs a first video signal and a second video signal, the phases of which are 180-degrees apart. The driving circuit also includes a common voltage generator 110 that receives the first and second clock signals FD1 and FD2 and outputs a first common voltage Vcom1 and a second common voltage Vcom2, the phases of which are 180-degrees apart. The waveforms input into and output from the controller IC 100 are shown in the FIG. 11. The common electrodes 140 are disposed in parallel with the data lines. The first common voltage Vcom1 is applied to the odd-numbered common lines, and the second common voltage Vcom2 is applied to the even-numbered common lines.

Figure 12:
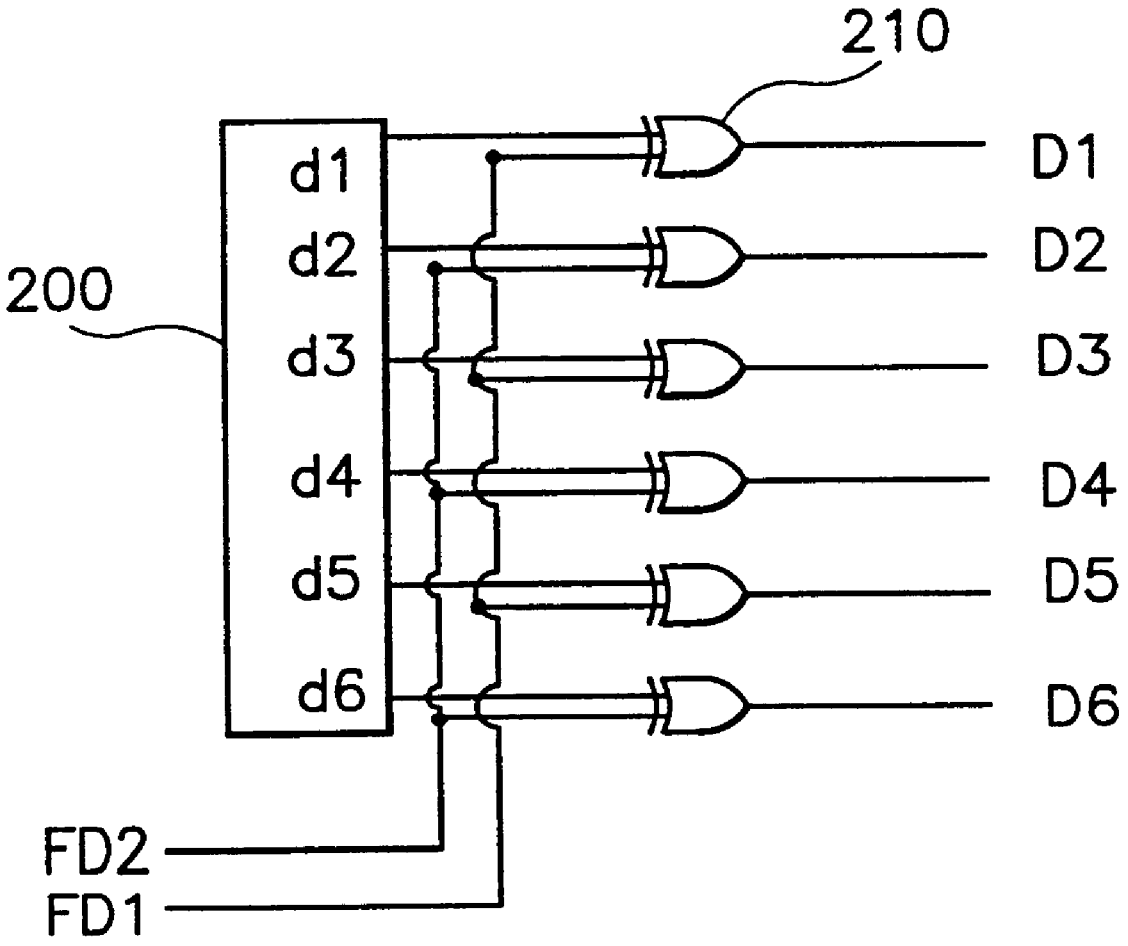
FIG. 12 shows a driving circuit having six output lines according to the preferred embodiment of the present invention.

The data driver IC 120 includes a latch 200, data terminals (d1 to d6 in the case of six data lines), and XOR (exclusive OR) gates 210 (160 in FIG. 10), as shown in FIG. 12. The output terminals of the XOR gates that are connected to odd data terminals (d1, d3, and d5) and the first clock signal FD1 are connected to the odd data lines D1, D3, and D5, respectively. The output terminals of the XOR gates that are connected to even data terminals (d2, d4, and d6) and the second clock signal FD2 are connected to the even data lines D2, D4, and D6, respectively.

The operation of the present embodiment is as follows. The controller IC 100 outputs the first and second clock signals FD1 and FD2 to the common voltage generator 110 and the data driver IC 120. The common voltage generator 110 provides the first common voltage Vcom1 synchronized with the first clock signal FD1 for the odd common electrodes, and Vcom2 synchronized with the second clock signal FD2 for the even common electrodes. As a result, the common electrodes 140 exhibit a phase pattern shown in FIG. 6*a*. The data driver IC 120 applies the output data generated by XOR operation of the clock signal FD1 to the odd data lines. The data driver IC 120 also applies the output data generated by XOR operation of the clock signals FD2 to the even data lines. Consequently, the phases of data signals applied to the odd and even data lines are 180-degrees apart.

Figure 11:
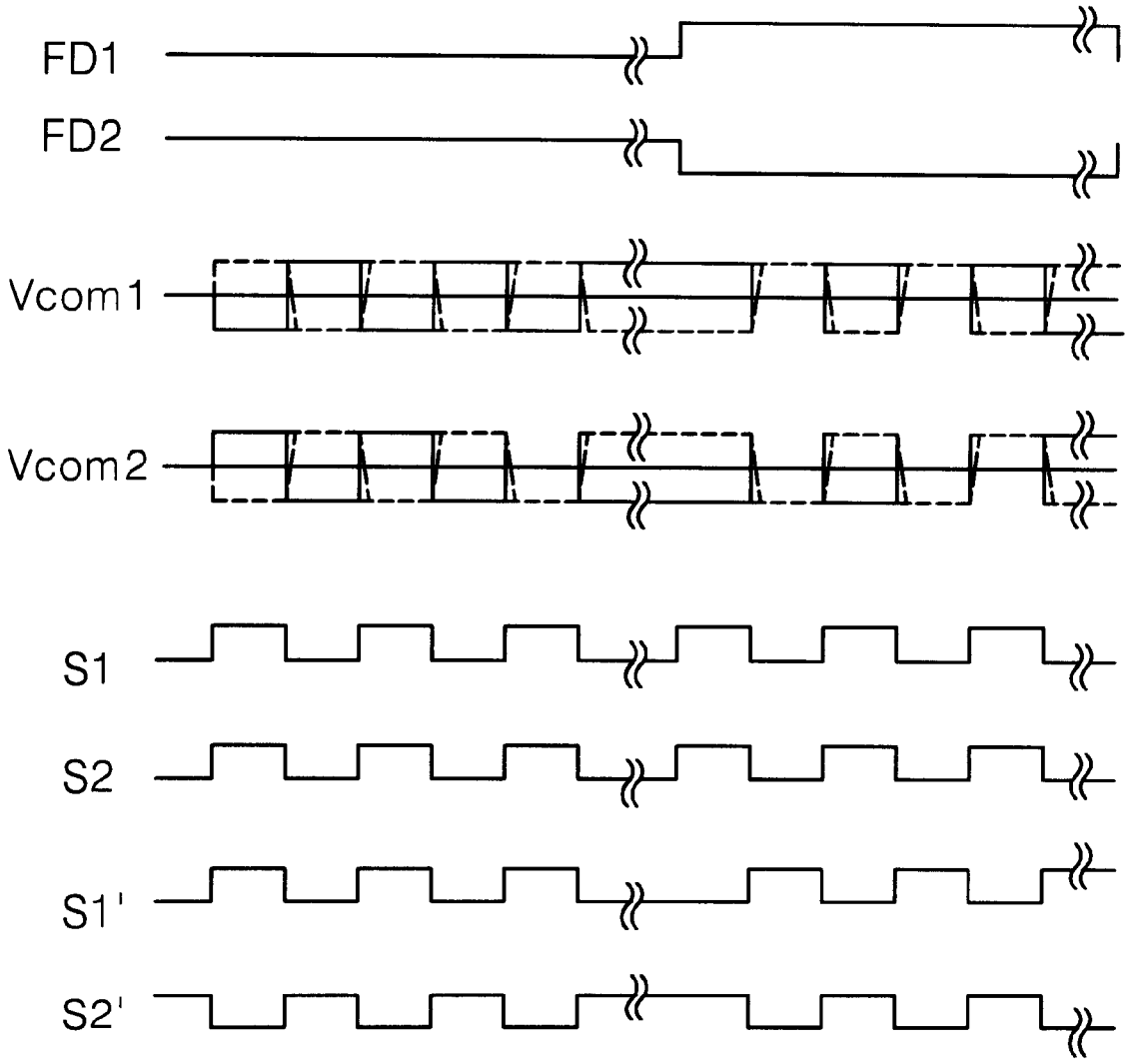
FIG. 11 shows waveforms for the driving circuit of FIG. 10.

The operation for generating the waveforms of the video data applied to the data lines is explained below in more detail. Suppose that a data driver IC includes latch 200 having six data output terminals d1 to d6 and six XOR gates 210 connected to the six data terminals, and the XOR gates connected with the odd terminals d1, d3, d5 are provided with the first clock signal FD1, whereas the XOR gates connected to the terminals d2, d4, d6 are provided with the second clock signal FD2. When the data output terminals output HIGH video data and the FD1 is a HIGH phase pulse, then the data signals output from terminals LOW phase pulses. On the other hand, the data signal output from terminals D2, D4, and D6 are HIGH phase pulses, since the second clock signal FD2 is in a LOW state, as shown in FIG. 11. This is because the XOR gate generates a LOW phase pulse when the phases of the two input signals are the same, otherwise it generates a HIGH phase signal. Table 1 shows the true-false table of the XOR operation.

TABLE 1

| First input | Second input | Output |
|---|---|---|
| 0 | 0 | 0 |
| 0 | 1 | 1 |
| 1 | 0 | 1 |
| 1 | 1 | 0 |

Generally, the electrical signal applied to drive the liquid crystal should not be a direct current signal because the liquid crystal deteriorates due to the direct current. Therefore, the data signal and the common voltage signal need to be alternating signals. Several methods have been developed for applying the alternating signal to the liquid crystal; e.g., a line inversion method and a dot inversion method. The dot inversion method has been found to be better than other methods. However, the dot inversion method needs to be designed in a double bank mode in a conventional liquid crystal display. Therefore, the efficiency of the panel usage is limited.

In the present invention, a similar data driver IC to that for the line inversion method can be used, and XOR gates are connected to the output terminals of the data driver IC. A first clock signal is applied to the XOR gate connected to the odd output terminals of the data driver IC. On the other hand, a second clock signal, whose phase is 180-degrees from that of the first clock signal is applied to the XOR gates connected to the even output terminals of the data driver IC. Therefore, the present invention provides a data driver 1C in which the dot inversion method is designed with a signal bank mode. Therefore, the LCD according to the present invention has a high efficiency in panel space usage and provides a high quality picture screen.

It will be apparent to those skilled in the art that various modifications and variations can be made in the data driver IC of the present invention without departing from the spirit or scope of the invention. Thus, it is intended that the present invention cover the modifications and variations of this invention provided they come within the scope of the appended claims and their equivalents. In particular, it is apparent that in place of XOR gates, XNOR may be used in the present invention. In such a case, the polarity of data supplied to each data terminal is merely reversed as compared with the case of using XOR gates.

What is claimed is:

1. A liquid crystal display device, comprising:

a first substrate including a plurality of odd data lines and even data lines and a plurality of scan lines, the plurality of odd and even data lines being substantially perpendicular to the plurality of scan lines;

a second substrate opposite the first substrate, the second substrate including a plurality of odd-numbered common electrodes and even-numbered common electrodes disposed substantially in parallel with the plurality of odd and even data lines, respectively;

a clock signal generator producing a first clock signal and a second clock signal, a phase of the first clock signal being 180-degrees from that of a phase of the second clock signal;

a common voltage generator applying a first common voltage to the odd-numbered common electrodes disposed on the second substrate, and a second common voltage to the even-numbered common electrodes disposed on the second substrate; and a data driver connected to the plurality of data lines through one side of the first substrate, the data driver including a latch circuit having a plurality of output terminals each connected to a respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines.

2. The liquid crystal display device according to claim 1, wherein the clock signal generator generates digital signals as the first clock signal and the second clock signal.

3. The liquid crystal display device according to claim 1, wherein the data driver is formed on the first substrate.

4. A circuit for driving a liquid crystal display device with a video data, comprising:

a latch for latching the video data to output video signals through a plurality of output terminals, the plurality of output terminals being divided into a first group and a second group;

a clock signal generator producing a first clock signal and a second clock signal, the phase of the first clock signal being 180-degrees from that of the second clock signal;

a plurality of first logical gates each performing an exclusive OR operation with the first clock signal and the video signal from the first group of the output terminals of the latch to output an operated signal; and a plurality of second logical gates each performing an exclusive OR operation with the second clock signal and the video signal from the second group of the output terminals of the latch to output an operated signal.

5. The circuit according to claim 4, wherein a plurality of data lines are consecutively numbered for identification purposes, and the first group of the data lines includes odd numbered data lines, and the second group of data lines includes even numbered data lines.

6. A liquid crystal display device, comprising:

a first substrate including:

a plurality of data lines separated as odd data lines and even data lines, a plurality of scan lines substantially perpendicular to the plurality of data lines, a plurality of pixel electrodes each disposed at areas surrounded by the scan lines and data lines, and a plurality of thin film transistors each disposed at a respective intersection of the data lines and the scan lines, a gate of each thin film transistor being connected to an adjacent scan line, a source of each thin film transistor being connected to an adjacent data line, and a drain of each thin film transistor being connected to an adjacent pixel electrode;

a second substrate opposite the first substrate, the second substrate including a plurality of odd common electrodes and even common electrodes disposed substantially in parallel with the plurality of data lines;

a liquid crystal material interposed between the first substrate and the second substrate;

a clock signal generator producing a first clock signal and a second clock signal, the phase of the first clock signal being 180-degrees from that of the second clock signal;

a common voltage generator applying a first common voltage to the odd common electrodes disposed on the second substrate, and applying a second common voltage to the even common electrodes disposed on the second substrate;

a data driver connected to the plurality of data lines through one side of the first substrate, the data driver including a latch circuit having a plurality of output terminals each connected to a respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines; and a scan driver outputting scan signals to the plurality of scan lines on the first substrate to drive the thin film transistors connected thereto.

7. The liquid crystal display device according to claim 6, wherein the data driver is formed on the first substrate.

8. The liquid crystal display device according to claim 6, wherein the scan driver is formed on the first substrate.

9. A driving circuit for providing display signals to a liquid crystal display panel through a plurality of data lines being separated as odd data lines and even data lines, the driving circuit comprising:

a clock signal generator producing a first clock signal and a second clock signal, a phase of the first clock signal being 180-degrees from that of a phase of the second clock signal; and a data driver to be connected to the plurality of data lines through one side of the liquid crystal display panel, the data driver including a latch circuit having a plurality of output terminals each to be connected to the respective one of the data lines through a respective gate, respective gates connected to the odd data lines receiving the first clock signal to output first pixel driving signals having a predetermined polarity to the respective odd data lines, respective gates connected to the even data lines receiving the second clock signal to output second pixel driving signals having a reverse polarity relative to the first pixel driving signals to the respective even data lines.

* * * * *